US006490958B1

(12) United States Patent
Charest et al.

(10) Patent No.: US 6,490,958 B1
(45) Date of Patent: Dec. 10, 2002

(54) APPARATUS FOR STORING CHARGE UNITS

(75) Inventors: Craig S. Charest, Burlington, VT (US); Franklin D. Krol, Pittsfield, MA (US)

(73) Assignee: General Dynamics Armament & Technical Products, Inc., Falls Church, VA (US)

( * ) Notice: Subject to any disclaimer, the term of this patent is extended or adjusted under 35 U.S.C. 154(b) by 0 days.

(21) Appl. No.: 10/042,187

(22) Filed: Jan. 11, 2002

(51) Int. Cl.[7] ..... F41A 9/00
(52) U.S. Cl. ..... 89/45
(58) Field of Search ..... 89/45, 33.04, 33.1

(56) References Cited

U.S. PATENT DOCUMENTS

| | | | | | |
|---|---|---|---|---|---|
| 770,320 | A | * | 4/1868 | Schneider | 126/70 |
| 2,779,245 | A | * | 1/1957 | Smith | 89/45 |
| 2,790,355 | A | * | 4/1957 | Sanford | 89/33.01 |
| 2,926,567 | A | * | 3/1960 | Warren | 89/33.01 |
| 3,331,281 | A | * | 7/1967 | Jafvert | 89/33.04 |
| 3,343,456 | A | * | 9/1967 | Christiansson | 89/33.01 |
| 4,011,794 | A | * | 3/1977 | Leshem | 89/45 |
| 4,898,071 | A | * | 2/1990 | Borgwarth | 414/676 |
| 5,131,315 | A | * | 7/1992 | Maher et al. | 89/33.1 |
| 5,347,908 | A | * | 9/1994 | Mouterde et al. | 89/34 |
| 5,367,810 | A | * | 11/1994 | Stead et al. | 42/17 |
| 5,458,044 | A | * | 10/1995 | Delbos | 89/33.1 |
| 6,073,534 | A | * | 6/2000 | Gagnon | 198/347.2 |
| 6,170,380 | B1 | * | 1/2001 | Bender-Zanoni et al. | 89/33.04 |
| 6,205,904 | B1 | * | 3/2001 | Boutet et al. | 89/33.1 |

FOREIGN PATENT DOCUMENTS

| | | | |
|---|---|---|---|
| FR | 2557282 | * | 6/1985 |

* cited by examiner

*Primary Examiner*—Charles T. Jordan
*Assistant Examiner*—Jordan M Lofdahl
(74) *Attorney, Agent, or Firm*—Finnegan, Henderson, Farabow, Garrett & Dunner, L.L.P.

(57) ABSTRACT

A friction restraint and latching assembly for a charge unit storage chamber defined by an elongated casing having an open end, and including a friction restraint bar of a length approximating that of the elongated casing, and supported at the periphery of the casing for axial and radial movement between a retracted position out of contact with charge units in the storage chamber and an engaged position in frictional contact with the charge units in the storage chamber and so that axial movement of the friction restraint bar toward the open end of the casing results in radial movement of the friction restraint bar to the engaged position. The friction restraint bare is biased yieldably to the engaged position. An actuating plunger, accessible at the open end of the elongated casing, is movable axially against the friction restraint bar to move the friction restraint bar against its bias to the retracted position, and a pivotal latch on the open end of the casing and connected with the actuating plunger is movable from a closed position over at least part of the open end of the casing to an open position upon movement of the actuating plunger to move the friction restraint bar to the retracted position.

18 Claims, 3 Drawing Sheets

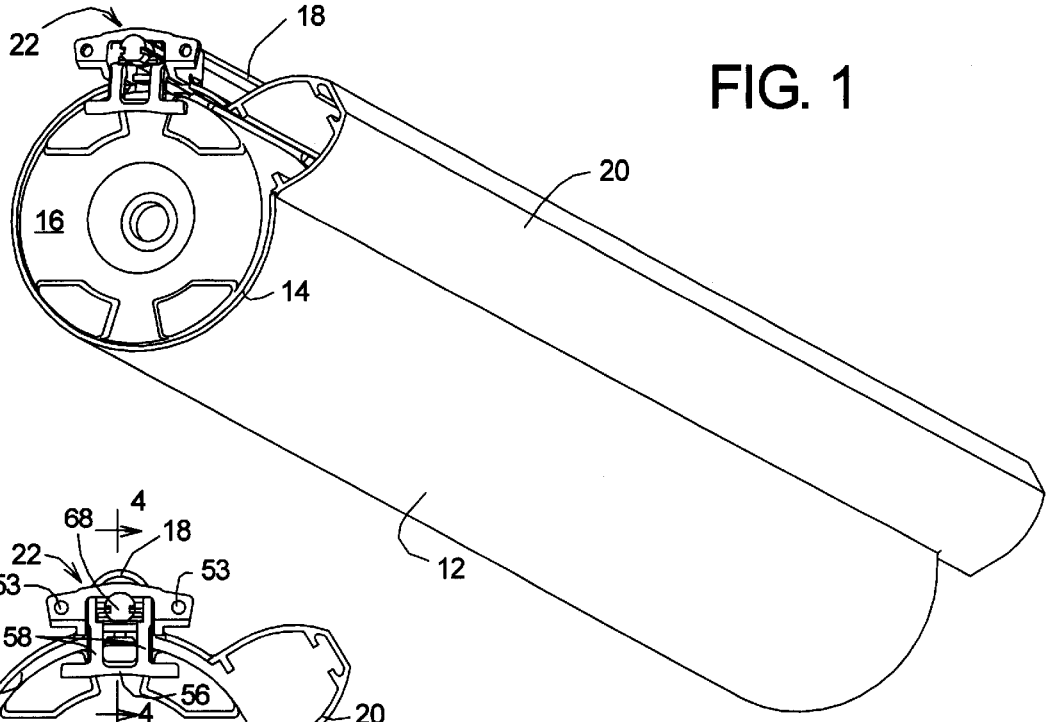
FIG. 1
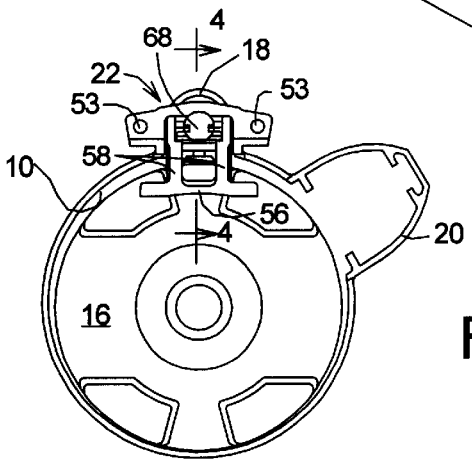
FIG. 2
FIG. 3
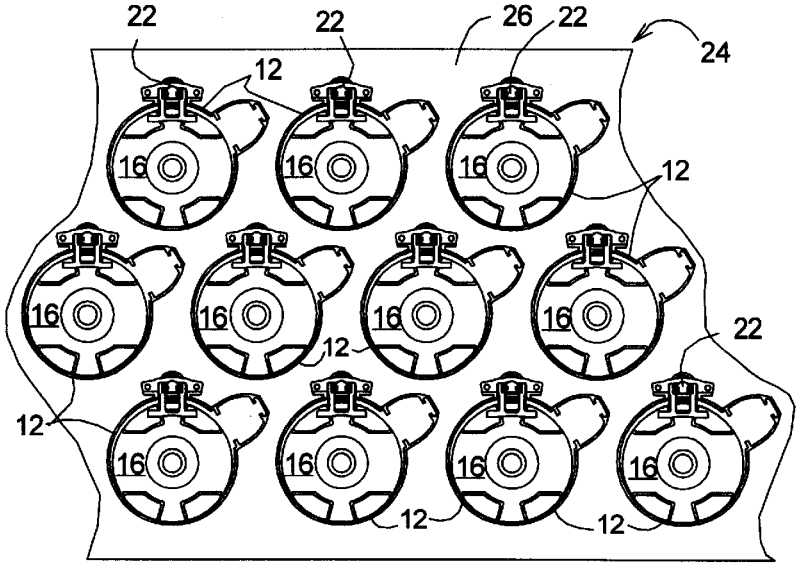

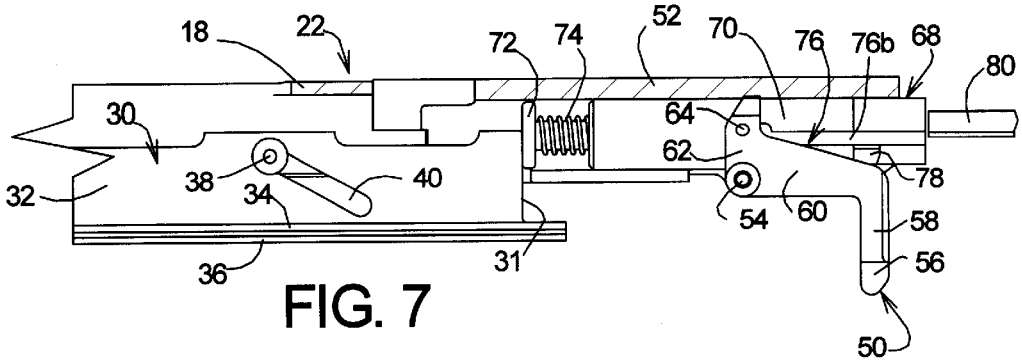
FIG. 7
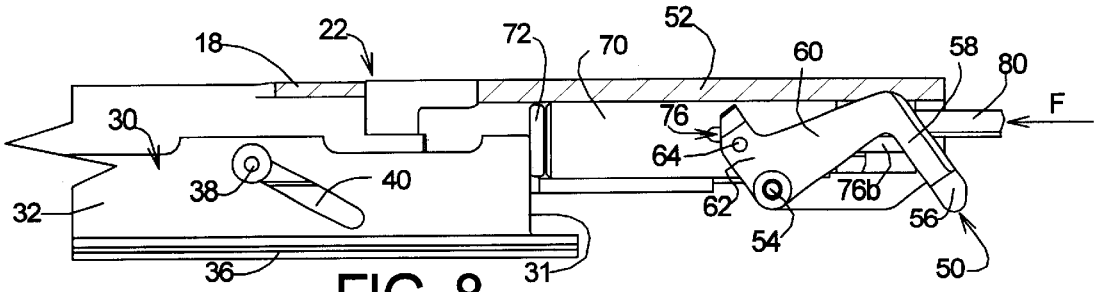
FIG. 8
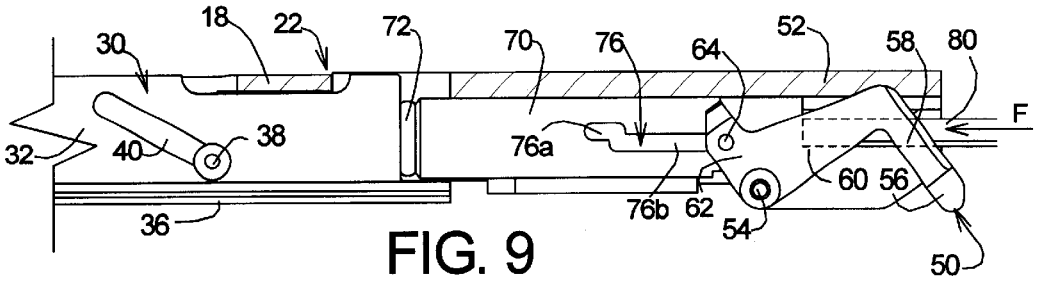
FIG. 9
FIG. 10
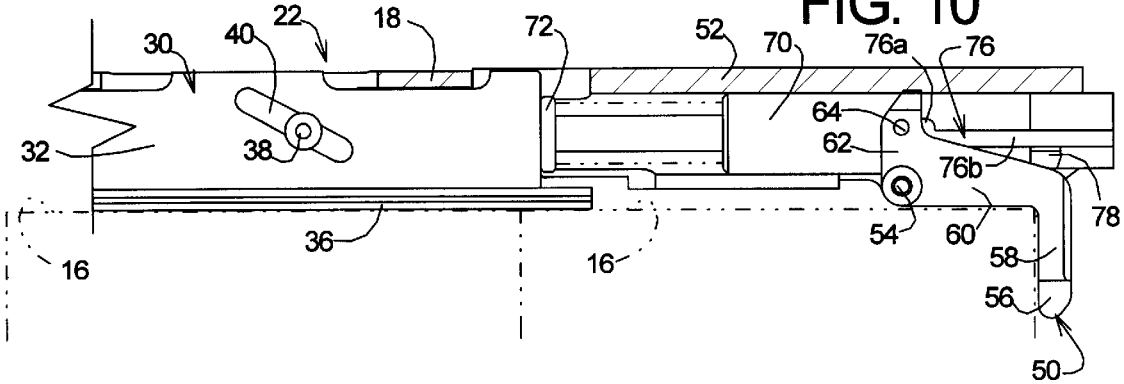

APPARATUS FOR STORING CHARGE UNITS

GOVERNMENT CONTRACT

Department of Defense/U.S. Army, Contract Number-DAA30-95-C-0009.

BACKGROUND OF THE INVENTION

1. Field of the Invention

This invention relates to apparatus for storing charge units, and, more particularly to such an apparatus for storing and handling artillery propellant charge units.

2. Description of the Related Art

The planned introduction of advanced artillery systems calls for the use of a fully automated ammunition handling capability including the storage of propellant charge units. The propellant charge units are molded, combustible containers filled with either ball or stick propellant and referred to as Modular Artillery Charge Systems (MACS). These propellant charge units or modules are illustrated and described in commonly assigned U.S. Pat. No. 6,073,534, the disclosure of which is hereby incorporated by reference.

In operating large caliber guns such as self propelled field howitzers, naval guns and fixed gun emplacements, a selective number of the individual propellant charge units would be used, depending upon the type of projectile, range, etc. required. The MACS transfer mechanism then ideally must be able to selectively transfer into or access from a storage magazine, a single charge, or multiple charges. Because the MACS use combustible, nitrocellulose based charge containers having the external form of right circular cylinders and have handling and strength characteristics similar to cardboard, but which are highly combustible, they present unique problems to automated handling and storage with the space constraints existing in the place of their application.

In commonly assigned U.S. Pat. No. 6,170,380, the complete disclosure of which is hereby incorporated by reference, an apparatus for storing and handling propellant charge units is disclosed and, in which, a transfer tube carried by a shuttle is movable into alignment with each of a plurality of tubular storage chambers in a storage magazine. A feed mechanism on the shuttle and in each chamber of the storage magazine is actuated by the shuttle and functions to transfer one or more charge units between the storage chamber and the shuttle mounted transfer tube, both during loading and unloading charge units to and from the storage magazine.

To retain the charge units in the magazine, each tubular storage chamber is equipped with a radially movable friction bar that is biased into engagement with the periphery of all charge units in the chamber. Also, a front end closure gate moves between an open position and a closed position relative to the otherwise open end of the storage chamber through which the units are transferred.

The radial bias of the friction bar is effected by an axial spring exerting a force tending to move the bar toward the open end of the storage chamber. Angular camming slots supporting the friction bar convert the axial force of the spring to radial movement of the friction bar against the periphery of the charge units for frictional retention of the charge units under the bias of the spring. To release the friction bar, a reciprocatable plunger on the shuttle transfer tube advances the friction bar against the axial spring, so that the angular camming slots retract the friction bar from the periphery of the charge units in the tubular chamber. The closure gate, on the other hand, is separately actuated and radially biased to the closed position by a separate spring. The closure gate is opened or moved away from the open end of the chamber in a radial direction by a locating pin on the shuttle transfer tube that functions both to ensure axial alignment of the shuttle carried transfer tube with the tubular storage chamber, and to cam the closure gate from its closed position radially to its open position to permit loading or unloading of charge units between an individual storage chamber and the transfer tube after the friction bar is retracted from its position of peripheral engagement with the charge units.

SUMMARY OF THE INVENTION

The advantages and purpose of the invention will be set forth in part in the description which follows, and in part will be obvious from the description, or may be learned by practice of the invention. The advantages and purpose of the invention will be realized and attained by means of the elements and combinations particularly pointed out in the appended claims.

To attain the advantages and in accordance with the purpose of the invention, as embodied and broadly described herein, the invention is directed to an apparatus for storing charge units, comprising a storage magazine including at least one axially elongated storage space having at least one open end for transfer of the charge units to and from the storage space, a friction restraint for engaging the charge units stored in the at least one axially elongated chamber and inhibiting axial movement of the charge units toward the open end thereof, and means for releasing the friction restraint at least upon transfer of a charge unit through the open end. A latching means is provided for at least partially closing the open end, and is movable between a closed position and an open position upon operation of the means for releasing the friction restraint.

In another aspect, the advantages and purpose of the invention are attained by a friction restraint and latching assembly for a charge unit storage chamber defined by an elongated casing having an open end. The assembly comprises a friction restraint bar of a length approximating that of the elongated casing, means for supporting the friction restraint bar at the periphery of the casing for axial and radial movement between a retracted position out of contact with charge units in the storage chamber and an engaged position in frictional contact with the charge units in the storage chamber and so that axial movement of the friction restraint bar toward the open end of the casing results in radial movement of the friction restraint bar to the engaged position, and biasing means for exerting an axial force on the friction restraint bar and yieldably retaining the friction restraint bar in the engaged position. An actuating plunger, accessible at the open end of the elongated casing, is movable axially against the friction restraint bar to move the friction restraint bar against the biasing means to the retracted position. A pivotal latch on the open end of the casing is connected with the actuating plunger to move from a closed position over at least part of the open end of the casing to an open position upon movement of the actuating plunger to move the friction restraint bar to the retracted position.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate an exemplary embodiment of the invention and together with the description, serve to explain the principles of the invention. In the drawings, FIG. 1 is a perspective view illustrating a single storage chamber of the present invention;

FIG. 2 is an end view of the storage chamber illustrated in FIG. 1;

FIG. 3 is a fragmentary end view of a storage magazine incorporating a plurality of the storage chambers shown in FIGS. 1 and 2;

FIG. 7 is a side view in partial cross section illustrating the friction restraint and latching device of FIG. 4 in one condition during operation;

FIG. 8 is a side view in partial cross section illustrating the friction restraint and latching device of FIG. 4 in another condition during operation;

FIG. 9 is a side view in partial cross section illustrating the friction restraint and latching device of FIG. 4 in still another condition during operation;

FIG. 10 is a side view in partial cross section illustrating the friction restraint and latching device of FIG. 4 in a condition after the storage chamber is loaded with charge units.

DESCRIPTION OF THE PREFERRED EMBODIMENT

Figure 5:
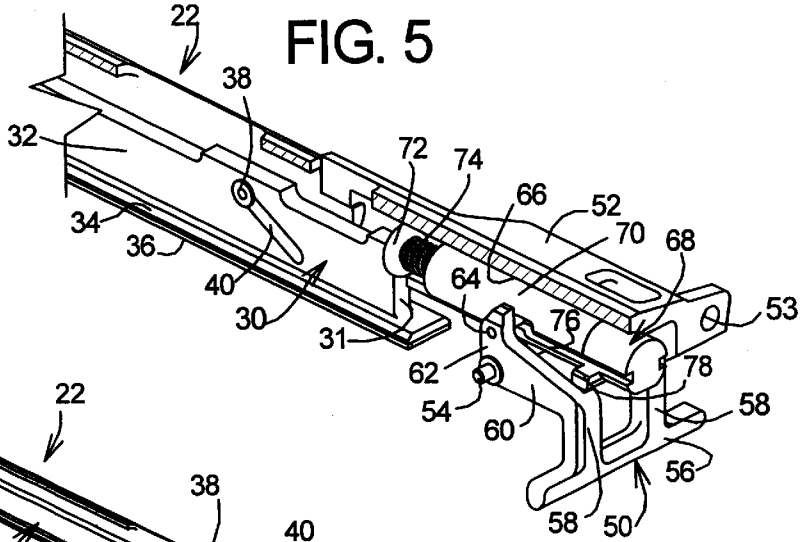
FIG. 5 is an enlarged fragmentary perspective view showing one end of the device shown in FIG. 4.

Reference will now be made in detail to the presently preferred embodiment of the invention, an example of which is illustrated in the accompanying drawings. Wherever possible, the same reference numbers will be used throughout the drawings to refer to the same or like parts.

In accordance with the present invention, an apparatus for storing charge units comprises a storage magazine including at least one axially elongated storage chamber having at least one open end for transfer of the charge units to and from the storage chamber, a friction restraint for engaging and releasing the charge units stored in the at least one axially elongated chamber and inhibiting axial movement of the charge units toward the open end thereof, and latching means for at least partially closing the open end, that is movable between a closed position and an open position upon engagement and release of the friction restraint.

In the illustrated embodiment, and as shown in FIGS. 1–3, an axially elongated storage chamber 10 is defined by a generally tubular casing 12 having an open end 14, through which cylindrical charge unit 16 may be loaded and unloaded into and out of the chamber 10. The tubular casing 12 has a pair of radially projecting housings 18 and 20 that extend for the full length of the tubular casing 12 and open through the periphery of the tubular casing 12 to the storage chamber 10. The housing 18 receives the friction restraint and latching assembly of the present invention, which is designated generally the reference number 22, and which will be described in more detail hereinafter. The other radially projected housing 20 receives the feed screw mechanism (not shown) for discharging the charge units 16 out of the storage chamber 10, as fully illustrated and described in the above-cited commonly assigned U.S. Pat. No. 6,170,380, incorporated herein by reference.

Also as disclosed in the commonly assigned U.S. Pat. No. 6,170,380, and as shown in FIG. 3 of the accompanying drawings, the storage chambers 10 are incorporated in a storage magazine 24 having end walls 26 (only one end wall is shown in FIG. 3) to support opposite ends of a plurality of the tubular casings 12. U.S. Pat. No. 6,170,380 further discloses in detail, a shuttle mechanism (not shown in the accompanying drawings) having a transfer tube positionable in alignment with the open ends 14 of the tubular casings 12 for transfer of charge units 2 and from the chambers 10 by a motor and drive train mounted on the shuttle mechanism.

In accordance with the present invention, the friction restraint and latching assembly comprises a friction restraint bar of a length approximating that of the elongated casing, means for supporting the friction restraint bar at the periphery of the casing for axial and radial movement between a retracted position out of contact with charge units in the storage chamber and an engaged position in frictional contact with the charge units in the storage chamber, and so that axial movement of the friction restraint bar toward the open end of the casing results in radial movement of the friction restraint bar to the engaged position, and biasing means for exerting an axial force on the friction restraint bar and yieldably retaining the friction restraint bar in the engaged position. An actuating plunger, accessible at the open end of the elongated casing, is movable axially against the friction restraint bar to move the friction restraint bar against the biasing means to the retracted position. A pivotal latch on the open end of the casing is connected with the actuating plunger to move from a closed position over at least part of the open end of the casing to an open position upon movement of the actuating plunger to move the friction restraint bar to the retracted position.

Figure 4:
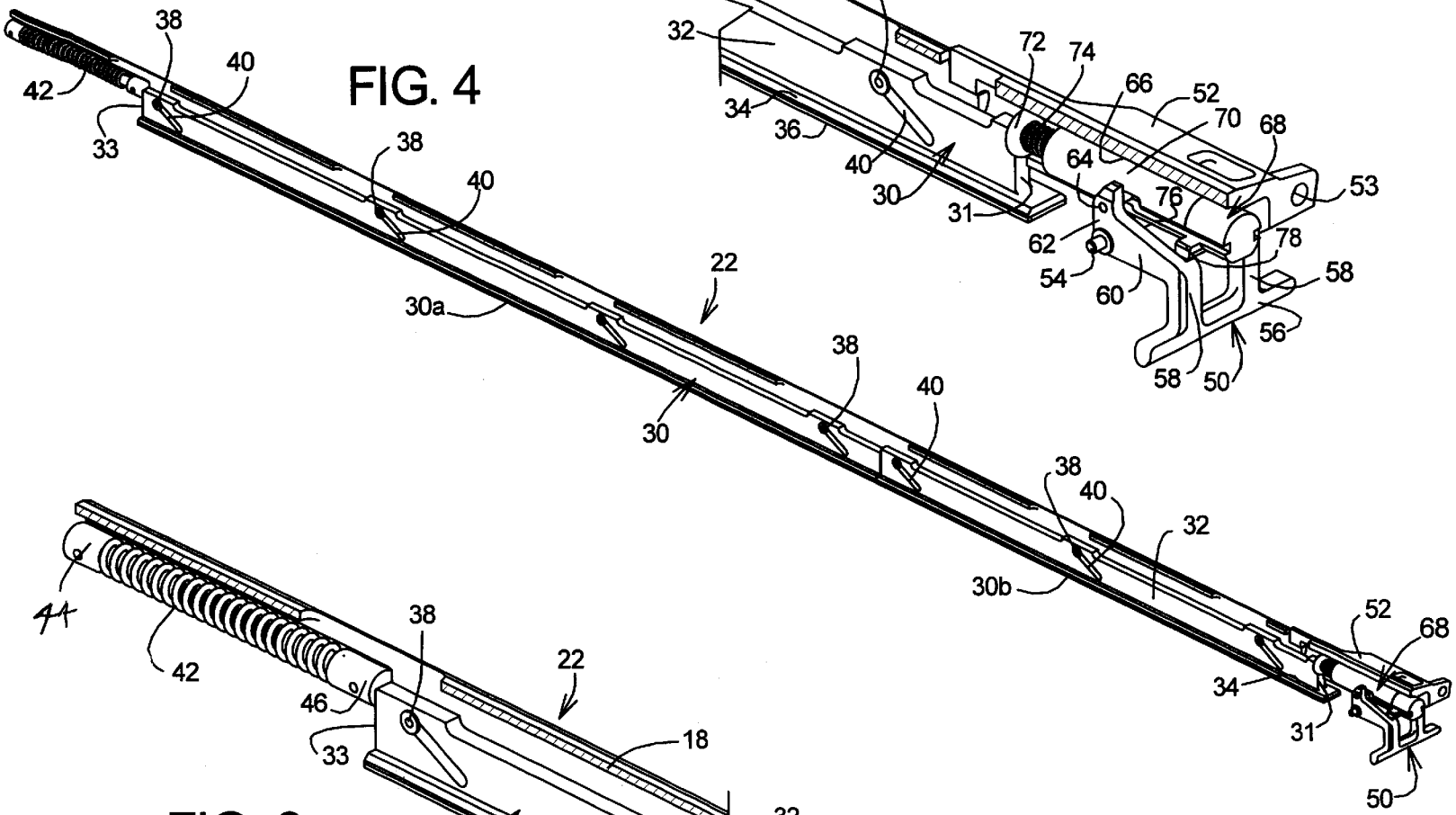
FIG. 4 is a perspective view, in partial cross section, illustrating a friction restraint and latching device used in the storage chamber of FIG. 1.
Figure 6:
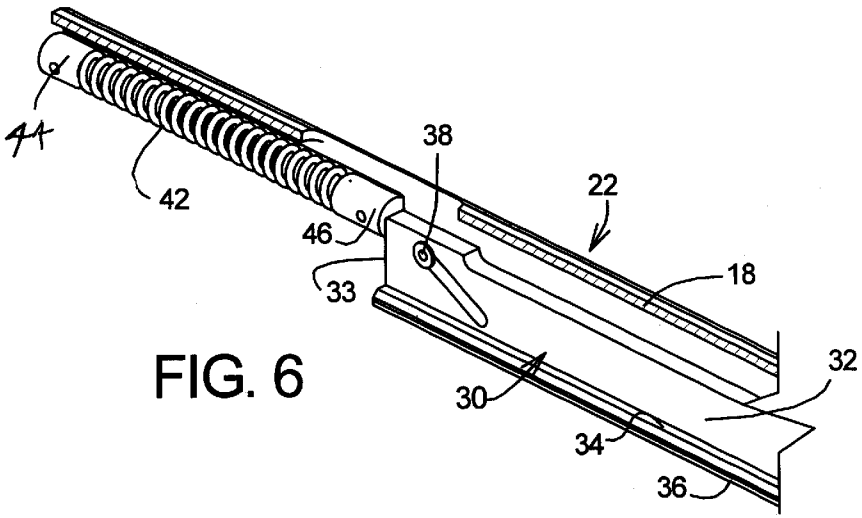
FIG. 6 is an enlarged fragmentary perspective view showing the opposite end of the device shown in FIG. 4.

In the illustrated embodiment, details of the friction restraint and latching assembly 22 are shown most clearly in FIGS. 4–6 of the drawings. In FIG. 4, the housing 18 is cut away to show the individual components of the assembly 22.

The friction restraining function of the assembly 22 is served by a friction restraint bar 30 having front and rear ends 31 and 33, respectively, and which may include separate tandem sections 30*a* and 30*b*, as shown in FIG. 4. The construction of the friction restraint bar 30 is essentially the same as that disclosed in U.S. Pat. No. 6,170,380 and, as such, is inverted T-shape in profile to define a radial web 32, and a flange 34 to which a friction pad 36 is affixed, such as by an appropriate adhesive.

The friction restraint is supported in the housing 18 by pins 38, anchored in the housing 18, and extending through cam slots 40 in the web 32. As shown, the cam slots 40 are inclined inwardly in relation to the storage chamber 10 and forwardly or toward the open end 14 of the casing 12. As a result, rearward movement of the friction restraint bar 30 relative to the casing 12 and the pins 38 will cause outward movement of the friction restraint bar to a retracted position, and forward movement, or movement of the friction restraint bar 30 toward the open end 14 of the casing 12, will cause inward movement of the friction restraint bar to a charge unit engaging position.

Although such movement of the friction restraint bar during operation of the assembly 22 will be described in more detail below, as shown in FIGS. 4 and 6, a compression spring 42 is mounted on the housing 18 to extend between a fixed abutment 44 and the head of a pin 46 abutting the rear end 33 of the friction restraint bar 30. The spring 42 thus exerts a biasing force acting to maintain the friction restraint bar 30 in a forward direction, or toward the open end 14 of the casing 12. As a result of the action of the pins 38 and the inclined slots 40, the friction restraint bar 30 is also retained under the bias of the compression spring 42 inwardly of the chamber 10 against the peripheries of the charge units 16 in the chamber 10.

The latching function of the assembly 22 in the illustrated embodiment is served by a pivotal latch, generally designated by the reference number 50, and shown most clearly in FIG. 5. The latch 50 is supported by a latch mount 52 that is fixed in relation to the front end of the housing 18 by bolts (not shown) extending through holes 53 and into the front end wall 26 of the magazine 24. The latch 50 is pivotal about a pivot axis perpendicular to the axis of the casing 12, the pivot axis being defined in the illustrated embodiment by a pin 54 secured at opposite ends in the latch mount 52.

In the illustrated embodiment, the latch 50 is cast or otherwise formed in one piece to include a bar-like gate portion 56 at the end of leg portions 58 depending at substantially right angles from long arms 60 of bell crank levers having short arms 62 extending at right angles from the long arm 60, and above the pivot pin 54. Each of the short arms 62 supports an inwardly extending follower pin 64 at its distal end.

The latch mount 52 defines a guide way 66 to support a generally cylindrical actuator plunger, designated generally by the reference number 68, for axial movement in alignment with the front end 31 of the friction retaining bar 30. The actuating plunger 68 includes a cylindrical body 70, a headed pin 72, slidable axially in relation to the body 70, and a compression spring 74 operable to yieldably resist movement of the headed pin 72 toward the body 70.

Shaped control grooves 76 are formed on diametrically opposite sides of the plunger body 70, and receive the follower pins 64 in the bell crank lever short arms 62. Also, a pair of oppositely extending lugs 78 on the plunger body overlie the top ends of the leg portions 58 to lock the latch 50 in the position shown in FIG. 5, given the illustrated relative positions of the latch 50, the actuating plunger 68, and the friction restraint bar 30.

Operation of the friction restraint and latching assembly 22 during loading and unloading charge units to and from the chamber 10 may be understood by reference to FIGS. 7–10 of the drawings. As disclosed in the above-cited U.S. Pat. No. 6,170,380, transfer of charge units 16 between the storage chamber 10 and a shuttle mechanism (not shown) is effected by a coupling of driving components on the shuttle mechanism with driven components associated with each storage chamber 10 in the magazine 24. One such driving component on the shuttle mechanism is a movable rack, the operating end of which is represented in each of FIGS. 7–9 by a push pin 80.

In the condition shown in FIG. 7, the components of the assembly are positioned as they would be in an empty chamber 10. Thus, the gate portion 56 of the latch 50 is positioned downwardly over a part of the open end 14 of the casing 12, and the friction restraint bar 30 is positioned by the biasing spring 42 (FIGS. 4 and 5) to be in its inward-most and forward-most position. As such, the friction restraint bar 30 extends into the chamber 10 and would interfere with loading of charge units 16 into the chamber 10. If it is assumed that the shuttle mechanism (not shown), is positioned in alignment with a chamber 10 in which the assembly 22 of FIG. 7 is positioned, a loading operation may commence with alignment of the pin 80 with the forward end of the plunger body 70.

As a force F is exerted on the push pin 80 by the unillustrated shuttle mechanism, as depicted in FIG. 8, the push pin 80 engages the front end of the plunger body 70 to advance the body 70 rearwardly. Upon such movement, the follower pins 64 in the control grooves 76 move from a stepped end portion 76*a* (FIG. 9) of the control grooves 76 into the major linear portion 76*b* thereof, causing the latch 50 to pivot about the pin 54 from the position illustrated in FIG. 7 to the position illustrated in FIG. 8. Because the spring 74 that resists movement of the headed pin 72 toward the body 70 of plunger 68 is weaker than the biasing spring 42 that urges the friction restraint bar 30 in a forward direction, opening of the latch in this manner will not cause movement of the friction restraint bar 30. However, as the push pin 80 advances the plunger body 70 further against the spring 74 so that the headed pin 72 is sandwiched between the plunger body 70 and the forward end 31 of the friction restraint bar 30, continued movement of the plunger body 70 by the push pin 80 will cause the friction restrain bar 30 to move to its retracted position against the bias of the spring 42. During such movement of the friction restraint bar 30, the latch 50 is retained in its open position by the major linear portions 76*b* of the control grooves 76.

After charge units 16 have been loaded into the chamber 10, the push pin 80 is retracted, thus allowing the biasing spring 42 to move the friction restraint bar 30 to engage the periphery of the loaded charge unit 16 as shown in FIG. 10. The spring 74 will operate to advance the plunger body 70 to its forward position, thus returning the latch 50 to its closed position over the end of the forward most charge unit in the chamber 10.

Unloading of charge units 16 from the chamber will occur when the pin 80 again moves the plunger body 70 and the friction restraint bar 30 to the position illustrated in FIG. 9.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. Apparatus for storing charge units, comprising:

a storage magazine including at least one axially elongated storage chamber having at least one open end for transfer of the charge units to and from the storage chamber;

a friction restraint for engaging the charge units stored in the at least one axially elongated chamber and inhibiting axial movement of the charge units toward the open end thereof; the friction restraint including a friction bar extending axially along one side of the at least one chamber, and a cam system for developing a radial normal force on the friction bar in response to an axial biasing force acting in the direction of the open end of the at least one chamber;

means for releasing the friction restraint at least upon transfer of a storable unit through the open end of the at least one storage chamber; and latching means for at least partially closing the open end, the latching means being movable between a closed position and an open position upon operation of the means for releasing the friction restraint, wherein the latching means is pivotal on a pivot axis perpendicular to the axially elongated storage chamber.

2. The apparatus of claim 1, wherein the latching means is biased to the closed position by the axial biasing force.

3. Apparatus for storing charge units, comprising:

a storage magazine including at least one axially elongated storage chamber having at least one open end for transfer of the charge units to and from the storage chamber;

a friction restraint for engaging the charge units stored in the at least one axially elongated chamber and inhibiting axial movement of the charge units toward the open end thereof; the friction restraint including a friction bar extending axially along one side of the at least one chamber, and a cam system for developing a radial normal force on the friction bar in response to an axial biasing force acting in the direction of the open end of the at least one chamber;

means for releasing the friction restraint at least upon transfer of a storable unit through the open end of the at least one storage chamber; and latching means for at least partially closing the open end, the latching means being movable between a closed position and an open position upon operation of the means for releasing the friction restraint, wherein the means for releasing the friction restraint comprises an axially movable plunger for moving the friction restraint against the axial biasing force.

4. The apparatus of claim 3, wherein the latch means is coupled to the plunger for movement to the open position upon movement of the plunger to engage the friction restraint.

5. The apparatus of claim 4, wherein the latching means is pivotal on a pivot axis perpendicular to the axially elongated storage chamber.

6. The apparatus of claim 5, wherein the latch means is coupled to the plunger by radial pins spaced from the pivot axis and slidable in control grooves in the plunger.

7. A friction restraint and latching assembly for a charge unit storage chamber defined by an elongated casing having an open end, the assembly comprising:

a friction restraint bar of a length approximating that of the elongated casing;

means for supporting the friction restraint bar at the periphery of the casing for movement between a retracted position out of contact with charge units in the storage chamber and an engaged position in frictional contact with the charge units in the storage chamber;

biasing means for yieldably retaining the friction restraint bar in the engaged position;

an actuating plunger accessible at the open end of the elongated casing and movable against the friction restraint bar to move the friction restraint bar against the biasing means to the retracted position; and pivotal latch on the open end of the casing and connected with the actuating plunger to move from a closed position over at least part of the open end of the casing to an open position upon movement of the actuating plunger to move the friction restraint bar to the retracted position.

8. The friction restraint and latching assembly of claim 7, wherein the friction restraint bar is supported for axial and radial movement between the retracted position and the engaged position.

9. The friction restraint and latching assembly of claim 8, wherein axial movement of the friction restraint bar toward the open end of the casing results in radial movement of the friction restraint bar to the engaged position.

10. The friction restraint and latching assembly of claim 9, wherein the actuating plunger is movable axially in alignment with the friction restraint bar 30.

11. The friction restraint and latching assembly of claim 10, wherein the actuating plunger includes a cylindrical body, a headed pin slidable axially in relation to the body, and a compression spring operable to yieldably resist movement of the headed pin toward the body.

12. The friction restraint and latching assembly of claim 8, wherein the latch is supported by a latch mount that is fixed in relation to the open end of the casing.

13. The friction restraint and latching assembly of claim 12, wherein the latch is pivotal about a pivot axis perpendicular to the axis of the casing.

14. The friction restraint and latching assembly of claim 13, wherein the pivot axis is defined by a pin secured at opposite ends in the latch mount.

15. The friction restraint and latching assembly of claim 13, wherein the the latch is formed in one piece and includes a bar-like gate portion to overlie the open end of the casing in the closed position.

16. The friction restraint and latching assembly of claim 15, wherein the gate portion is supported at the ends of leg portions depending at substantially right angles from first arms of bell crank levers having second arms extending at right angles from the first arms.

17. The friction restraint and latching assembly of claim 15, wherein each of the second arms supports an inwardly extending follower pin engageable in a control groove in the actuating plunger.

18. The friction restraint and latching assembly of claim 17, wherein the control grooves are formed on diametrically opposite sides of the actuating plunger.

* * * * *